US012172818B2

(12) United States Patent
Bischoff et al.

(10) Patent No.: US 12,172,818 B2
(45) Date of Patent: Dec. 24, 2024

(54) PALLET CONTAINER

(71) Applicant: MAUSER-WERKE GMBH, Bruehl (DE)

(72) Inventors: Sebastian Bischoff, Niederkassel (DE); Markus Meyer, Nideggen-Schmidt (DE); Klaus-Peter Schmidt, Bonn (DE)

(73) Assignee: MAUSER-WERKE GmbH (DE)

( * ) Notice: Subject to any disclaimer, the term of this patent is extended or adjusted under 35 U.S.C. 154(b) by 0 days.

(21) Appl. No.: 17/769,538

(22) PCT Filed: Oct. 16, 2020

(86) PCT No.: PCT/EP2020/000178

§ 371 (c)(1),
(2) Date: Apr. 15, 2022

(87) PCT Pub. No.: WO2021/073766

PCT Pub. Date: Apr. 22, 2021

(65) Prior Publication Data

US 2024/0140675 A1 May 2, 2024

(30) Foreign Application Priority Data

Oct. 18, 2019 (DE) ..... 20 2019 004 316.0
Dec. 5, 2019 (DE) ..... 20 2019 004 962.2

(51) Int. Cl.
*B65D 77/04* (2006.01)
*B65D 19/10* (2006.01)
(Continued)

(52) U.S. Cl.
CPC ..... *B65D 77/0466* (2013.01); *B65D 19/10* (2013.01); *B65D 19/18* (2013.01);
(Continued)

(58) Field of Classification Search
CPC ..... B65D 77/0466; B65D 19/36; B65D 2519/00547; B65D 2519/0032
(Continued)

(56) References Cited

U.S. PATENT DOCUMENTS 5,680,955 A * 10/1997 Schutz ..... B65D 77/0466 220/1.5
7,140,490 B2 * 11/2006 Przytulla ..... B65D 77/0466 220/23.9
10,875,696 B2 * 12/2020 Schütz ..... B65D 77/0466

FOREIGN PATENT DOCUMENTS

DE 9202045 U1 9/1992
DE 102016000072 A1 7/2017
WO 2017024332 A1 2/2017

OTHER PUBLICATIONS

International Search Report, dated Feb. 26, 2021 in corresponding International Application No. PCT/EP2020/000178.

* cited by examiner

*Primary Examiner* — Anthony D Stashick
*Assistant Examiner* — Raven Collins
(74) *Attorney, Agent, or Firm* — Morris, Manning & Martin, LLP; Daniel E. Sineway, Esq.

(57) ABSTRACT

The present invention describes a pallet container (10) for storing and transporting fluid or flowable filling materials, having a thin-walled, rigid plastics inner container (12) made from thermoplastic plastics material, having a tubular grid frame (14) which tightly surrounds the plastics inner container (12) as a supporting covering and which comprises horizontal and vertical tubular rods (18, 20) which are welded to each other, and having a base pallet (16) on which the plastics inner container (12) is positioned and to which the tubular grid frame (14) is securely connected, wherein at least two rod-shaped transverse cross-members (22) are
(Continued)

provided above the plastics inner container (12) and are fixed with the two ends thereof via a screw connection to two mutually opposite side walls in the upper region of the tubular grid frame (14). In order to configure the handling of such pallet containers (10) with manual gripping in the upper region of the tubular grid frame (14) in a safer manner and to prevent possible risks of injuries, there is provision according to the invention for the screw connections of the transverse cross-members (22) to be constructed in a completely covered manner.

19 Claims, 4 Drawing Sheets

(51) Int. Cl.
*B65D 19/18* (2006.01)
*B65D 19/38* (2006.01)

(52) U.S. Cl.
CPC .. *B65D 19/385* (2013.01); *B65D 2519/00009* (2013.01); *B65D 2519/00164* (2013.01); *B65D 2519/00512* (2013.01); *B65D 2519/00532* (2013.01); *B65D 2519/00547* (2013.01)

(58) Field of Classification Search
USPC ..... 220/23.87, 23.91
See application file for complete search history.

PALLET CONTAINER

CROSS REFERENCE TO RELATED APPLICATIONS

This application is a national phase of PCT application No. PCT/EP2020/000178, filed Oct. 16, 2020, which claims priority to DE patent application No. 2019004316.0, filed Oct. 18, 2019 and DE patent application No.202019004962.2, filed Dec. 5, 2019, all of which are incorporated herein by reference thereto.

BACKGROUND OF THE INVENTION

The present invention relates to a pallet container for storing and transporting fluid or flowable filling materials, having a thin-walled, rigid inner container made from thermoplastic plastics material, having a tubular grid frame which tightly surrounds the plastics inner container as a supporting covering and which comprises horizontal and vertical tubular rods which are welded to each other, and having a base pallet on which the plastics inner container is positioned and to which the tubular grid frame is securely connected, wherein two rod-shaped transverse cross-members are provided above the plastics inner container and are fixed with the two ends thereof via a screw connection by means of threaded screws to two mutually opposite side walls in the upper region of the tubular grid frame.

The rod-like transverse cross-members are intended to prevent excessive bulging of the plastics inner container or the upper base thereof with a central screw cap, in particular in the event of transport impacts and dynamic vibrations, and also serve inter alia, in the event of an undesirable overturning of the pallet container, to retain the plastics inner container in the tubular grid frame on the base pallet and to prevent it from sliding out of the tubular grid frame. In order to allow a simple exchange of the plastics inner container for multiple uses of the pallet container, the transverse cross-members are releasably secured with the two ends thereof in the upper region of the tubular grid frame, generally screwed. Such a pallet container having two transverse cross-members extending parallel is known, for example, from the publication WO 2012085940 A2. In a pallet container which is described in the publication DE 4425630 A1, exactly four transverse cross-members are provided, wherein two transverse cross-members which obliquely intersect with each other cover one half of the plastics inner container, respectively.

Problem

Filled pallet containers having a total weight of often more than 1 t are handled, for example, during unloading from a truck or when being stored in a high-bay warehouse by means of forklift truck vehicles. If pallet containers are intended to be transported only over short paths, for example, from a storage warehouse to a discharge station or the place of use of the filling material, then elevator trucks are also often used. However, empty pallet containers are often also manipulated by hand, such as, for example, tilted or pulled over a short distance. In this instance, the pallet container is always gripped using the fingers or by hand in the upper region of the tubular grid frame and in particular at the uppermost, horizontally extending tubular rod. Very often, the ends of the transverse cross-members and the screw connections thereof are also gripped in this case. The ends of the transverse cross-members are usually pressed flat, placed once around the uppermost horizontally extending tubular rod and, underneath, screwed against themselves. In this case, the ends of the transverse cross-members generally have sharp-edged punched edges and the freely inwardly projecting ends of the threaded screws are often overlooked. This can disadvantageously lead to serious cutting injuries or flesh wounds, even when protective gloves are worn.

Object

Accordingly, an object of the present invention is to configure the handling of such pallet containers with manual gripping in the upper region of the tubular grid frame in a safer manner and to prevent possible risks of injuries.

SUMMARY OF THE INVENTION

Solution

The intended reduction of risks of injuries is achieved in a reliable manner in that the transverse cross-members are screwed at their fastening points at the end faces of their two ends against two mutually opposite tubular rods in the upper region of the tubular grid frame and the threaded screws axially lead into the ends of the transverse cross-members, which ends are provided with an internal thread.

As a result of this constructive embodiment according to the invention of the transverse cross-member fixing arrangement, with the axial insertion of the threaded screws into the ends of the transverse cross-members, the screw connections of the transverse cross-members are completely covered and no free ends of the threaded screws can protrude from the components.

In an embodiment of the invention, it is provided that in each case a screw nut with an internal thread is inserted in a non-releasably secure manner in both ends of each transverse cross-member having a hollow tubular profile and the transverse cross-members are screwed firmly but releasably to an upper horizontal or vertical tubular rod of the tubular grid frame by means of the threaded screws which are screwed in on the end face. The threaded nut which is inserted in a secure and non-releasable manner can be simply pressed in, compressed or welded in.

A preferred embodiment of the invention provides for the respective ends of the transverse cross-members to be strongly compressed and for an internal thread to be directly formed in these compressed portions, wherein the transverse cross-members are screwed firmly but releasably to an upper horizontal or vertical tubular rod of the tubular grid frame by means of the threaded screws screwed in at the end face.

For these construction variants, there is provision for two adjacent ends of the transverse cross-members each to be screwed at the end face to the upper end of two adjacent vertical tubular rods in the flattened region close underneath the uppermost horizontally extending tubular rod.

In this instance, the two ends of the transverse cross-members are screwed in the completely flattened region of the vertical tubular rods. In order to provide a planar contact location for the ends of the transverse cross-members, the flattened regions of the vertical tubular rods are constructed to be extended and flattened for the screwed-in transverse cross-members and are therefore longer than the flattened regions of the remaining vertical tubular rods.

In a particular embodiment of the invention, the transverse cross-members are in the form of resilient spring elements, and do not extend linearly between their two fastening points, but instead extend in a curved manner and have one or more curved portions.

In a preferred embodiment, the transverse cross-members which are screwed-in in the completely flattened region of the vertical tubular rods each have a comparatively large curve which is bent in the horizontal plane, wherein the arcuately curved transverse cross-members are positioned flat on the upper base of the plastics inner container and the large curves of the two transverse cross-members are orientated so as to be directed away from each other.

In a modified embodiment, it is provided that the transverse cross-members are not configured linear between their two fastening points, but are each provided at their two ends with a small, downwardly formed curve and are each screwed on the end face from below against the uppermost circumferential horizontal tubular rod.

The transverse cross-members which are in the form of configured as resilient spring elements can be constructed as rod-like hollow tubes having a rectangular, quadratic, oval or round tubular profile, wherein the length of the transverse cross-members which are screwed at the end face between their two fastening points is designed to be larger than the direct spacing between the two fastening points of the transverse cross-members.

As a result of the advantageous configuration of the two transverse cross-members with an arcuately curved shape as a connection of the two opposite, long side walls of the tubular grid frame, the tensile forces which occur in the upper region of the tubular grid frame are substantially reduced by the transverse cross-members which are configured as resilient spring elements and the loads on the fastening points or screw connections of the transverse cross-members are significantly reduced. During a vibration test, the arcuately curved transverse cross-member acts as a resilient spring. During the vibrations, the upper base of the inner container vibrates up and down. These vibrations bring about in the upper and lower end points a resilient bending of the previously conventionally linear transverse cross-members upward and downward, which bending is converted directly into a reduction of the spacing between the fastening points. As a result of the reduction of the spacing, the tubular grid frame in the upper region is drawn inward significantly with each travel. With the new "spring solution" which is also flexible in a longitudinal direction, however, a substantially reduced deformation is achieved at the upper edge of the tubular grid frame and therefore a reduced loading of the components of the pallet container.

The invention is explained and described in greater detail below with reference to embodiments which are schematically illustrated in the drawings, in which:

DESCRIPTION OF PREFERRED EMBODIMENTS

Figure 1:
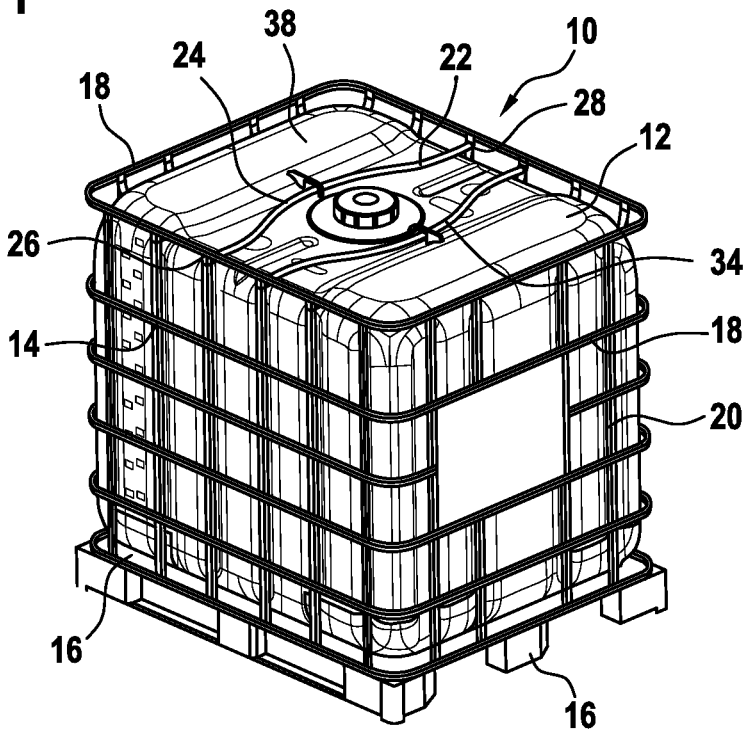
FIG. 1 is a perspective view of a pallet container according to the invention.

FIG. 1 illustrates a pallet container 10 according to the invention (also referred to as an "IBC"=Intermediate Bulk Container) for storing and transporting fluid or flowable filling materials. The pallet container 10 comprises a thin-walled, rigid plastics inner container 12 made from thermoplastic plastics material, for example, HDPE, a tubular grid frame 14 which tightly surrounds the plastics inner container 12 as a supporting covering and which comprises horizontal and vertical tubular rods 18, 20 which are welded to each other and a base pallet 16 on which the plastics inner container 12 is positioned and to which the tubular grid frame 14 is securely connected. Two rod-shaped transverse cross-members 22 are provided above the plastics inner container 12 and are fixed with their two ends to two mutually opposite side walls of the upper tubular grid frame 14. The two transverse cross-members 22 are configured as resilient spring elements 24 in an arcuately curved form. A particular constructive embodiment of the transverse cross-members 22 is distinguished in that, in their fastening points 26, 28, the transverse cross-members are screwed with the end faces of their ends in a secure but releasable manner against two mutually opposite tubular rods 18, 20 in the upper region of the tubular grid frame 14 and the threaded screws 48 axially lead into the ends of the transverse cross-members 22, 42, which ends are provided with an internal thread 44, 46.

The transverse cross-members 22, 42 are constructed not to be rectilinear or linear between their two fastening points 26, 28, but instead in a curved manner and have a comparatively large curve 34. In this case, the length of the transverse cross-members 22 between their two fastening points 26, 28 is constructed in a completely unusual manner to be greater than the direct spacing between the two fastening points 26, 28 at the ends of the transverse cross-members 22.

In order to obtain optimum resilience and spring-like action of the transverse cross-members 22, 42, the length of the transverse cross-members is, according to their line of curvature between their two fastening points, between 1% and 5% greater than the direct spacing (corresponding to a chord) between the two fastening points. The size of the curve and the arcuately curved form of the transverse cross-members is thereby brought about as a resilient spring element.

For standard pallet containers which have a filling volume of 600, 1000 or 1200 liters and which have the same dimension in terms of width and length, the spacing of the two fastening points 26, 28 from each other is approximately 960 mm and the effective length of the transverse cross-members 22 is approximately 993 mm. For the same standard pallet containers, the curved transverse cross-members 22 are intended to have a great radius of curvature between 300 mm and 700 mm, preferably 500 mm.

Figure 2:
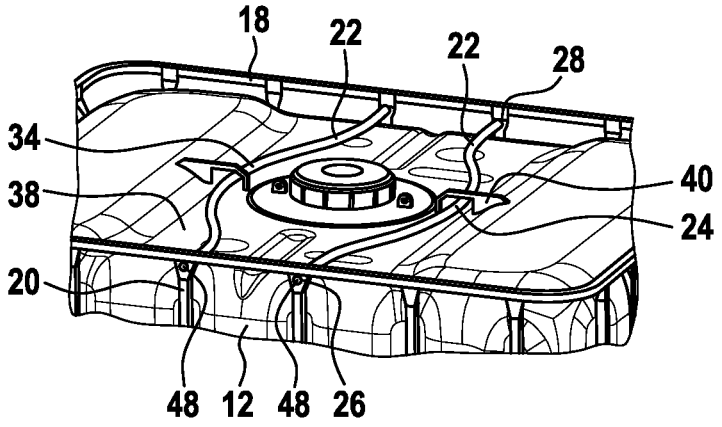
FIG. 2 is an enlarged partial view of the upper region of the pallet container according to the invention according to FIG. 1.

The above-described constructive embodiment of the invention can be seen in greater detail in FIG. 2 as an enlarged cut-out. In this case, it is shown that the arcuately curved transverse cross-members 22—in the fitted state—are positioned flat in a horizontal plane on the upper base 38 of the plastics inner container 12, wherein the large curves 34 of the two transverse cross-members 22 are orientated so as to be directed away from each other. In this case, the arcuately curved transverse cross-members 22 are each guided through a retention lug 40 which is formed from the upper base 38 of the plastics inner container 12, wherein the retention lugs 40 are arranged at the center of and engage over the fitted curved transverse cross-members 22. During handling and particularly during transport of pallet containers according to the invention and the loads which occur in this instance, the arcuately curved form allows the transverse cross-members to resiliently give way in the vertical direction, on the one hand, in the event of bulging of the upper base upward and downward—for example, also in the case of an internal pressure test or drop test—and can adapt to the bulging, so to speak, they "follow" the shape of the upper base.

The two ends of the transverse cross-members 22 are screwed by means of the threaded screws 48 in the fastening points 26, 28 on their end faces at the upper end of two adjacent, vertical tubular rods 20 in the compressed region closely below the uppermost horizontally extending tubular rod. In this case, the fastening points 26, 28 of the arcuately curved transverse cross-members 22 are—in comparison with previously conventional linear transverse cross-members—displaced further toward the center of the upper region of the tubular grid frame at a location where the greatest bulges with the greatest tensile loads occur and are to be absorbed. In this advantageous manner, the fastening points 26, 28 of the two transverse cross-members 22 are located at the upper end of two directly adjacent vertical tubular rods 20. With the conventional linearly constructed transverse cross-members, such a central connection would not be possible.

Figure 3:
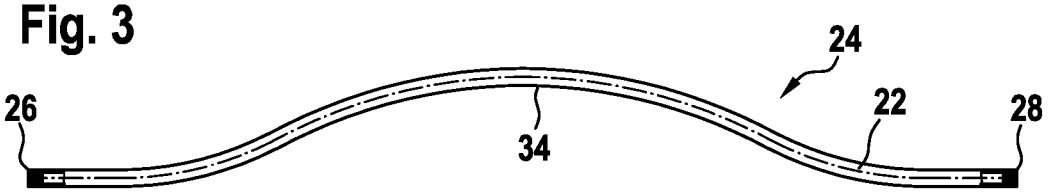
FIG. 3 is a plan view of a transverse cross-member configured as a resilient element.

FIG. 3 is a plan view of a curved transverse cross-member 22 designed as a spring element with a large radius of curvature of approximately 500 mm. In a preferred embodiment, the transverse cross-members 22, 42 have a round tubular profile with a diameter between 14 mm and 22 mm, preferably 16 mm, and a wall thickness between 0.7 mm and 1.2 mm, preferably 0.8 mm.

According to another construction type, however, the transverse cross-members 22, 42 may also have a square tubular profile with a side length between 14 mm and 20 mm, preferably 16 mm, and a wall thickness between 0.7 mm and 1.2 mm, preferably 0.8 mm.

Figure 4:
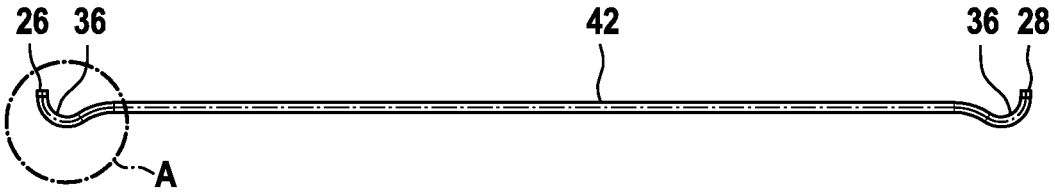
FIG. 4 is a side view of another embodiment of a transverse cross-member.
Figure 6:
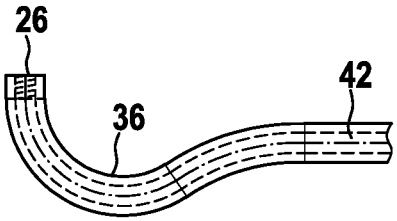
FIG. 6 is an enlarged partial view of the left end region of the transverse cross-member according to FIG. 4.

FIG. 4 is a side view of another embodiment of a transverse cross-member 42 with two curves which have in the end regions thereof—when viewed in the fitted state—a downwardly formed small curve 36 with a comparatively small radius and upwardly directed ends and (as can be seen in detail in FIG. 8) are each screwed with their end faces from below against the uppermost circumferential horizontal tubular rod 18. One end of the transverse cross-member 42 with two downwardly formed small curves 36 with a small radius is illustrated as an enlarged partial view in FIG. 6. A threaded nut 30 with an internal thread 44 (for example, M8 or M10) is securely and non-releasably inserted in the open ends of the hollow tubular profile of the transverse cross-member 42 with two curves 36. The non-releasably inserted threaded nut 30 can simply be pressed in, compressed or welded in.

Figure 5:
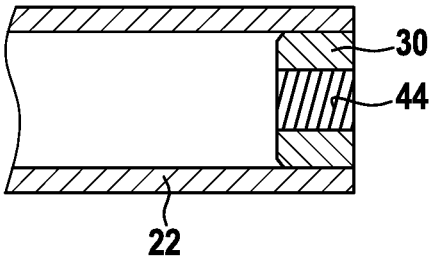
FIG. 5 is an enlarged partial view of the right end region of a transverse cross-member with a threaded nut inserted.

The enlarged illustration in FIG. 5 shows the right end of a transverse cross-member 22 (with a large curve) with the inserted threaded nut 30 which can also be non-releasably pressed in, compressed or welded in.

Figure 7:
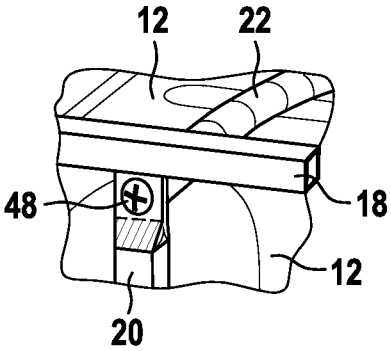
FIG. 7 is an enlarged partial view with a transverse cross-member being connected to the upper region of a tubular grid frame.

One possible fixing method, in which a threaded screw 48 is screwed into the end of the hollow tubular profile of the transverse cross-member 22 at the end face can be seen in FIG. 7. In this case, the transverse cross-member 22 is fixed close below the uppermost horizontal tubular rod 18 by means of the threaded screws 48 which are screwed in from the exterior at the end face—in the horizontal direction—at the upper flattened ends of two mutually opposite vertical tubular rods 20.

Figure 8:
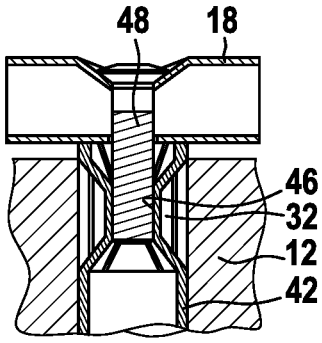
FIG. 8 is an enlarged partial cross-sectional view with an end-side screw connection of a transverse cross-member to the upper region of the tubular grid frame.

Another possible fixing method with screwed connection of the end faces of the transverse cross-member 42 with two small curves 36 is shown in FIG. 8 as an enlarged illustration. In this case, the two ends of the transverse cross-members 42 are strongly compressed in the radial direction, wherein a corresponding internal thread 46 is formed directly in the compressed portions 32. In this case, the transverse cross-members 42 with the smaller curves 36 at the end regions thereof are fixed with their end faces from below against the uppermost horizontal tubular rod 18 by means of a threaded screw 48 which is screwed in from above—in the vertical direction. Advantageously, the uppermost horizontal tubular rod 18 is slightly recessed at the top at the bore hole and the threaded screw 48 is configured as a flat-head, countersunk head or raised countersunk screw so that it does not project upwardly. The compressed portions 32 with a correspondingly formed internal thread 46 can naturally also be produced in the case of the transverse cross-member 22 (with only one large curve), as will be further explained below. The horizontal or vertical tubular rods 18, 20 of the tubular grid frame 14 are provided with a corresponding hole for the threaded screws 48 for screwing the threaded screws 48 into the ends of the transverse cross-members 22, 42.

The end-face screw connections of the transverse cross-members have the great advantage that the screw tips of the threaded screws are located completely in the hollow tubular profile of the transverse cross-members 22, 42 and are covered so that handling pallet containers according to the invention can no longer result in injuries, as was often the case with previously conventional open screw connections with projecting screw tips.

Previously conventional linear transverse cross-members can be screwed directly in the center axis with screws at the end only with difficulty. When the screws are tightened, the transverse cross-member also rotates and it would have to be fixed for assembly. This fixing is advantageously dispensed with in the case of the arcuately curved shape of the transverse cross-members according to the invention.

In the preferred embodiment of the transverse cross-members 22, 42 according to the invention, the two ends of the transverse cross-members 22, 42 are strongly compressed in the radial direction, wherein a corresponding internal thread, for example, M8, is formed directly in the compressed portions 32.

Figure 9:
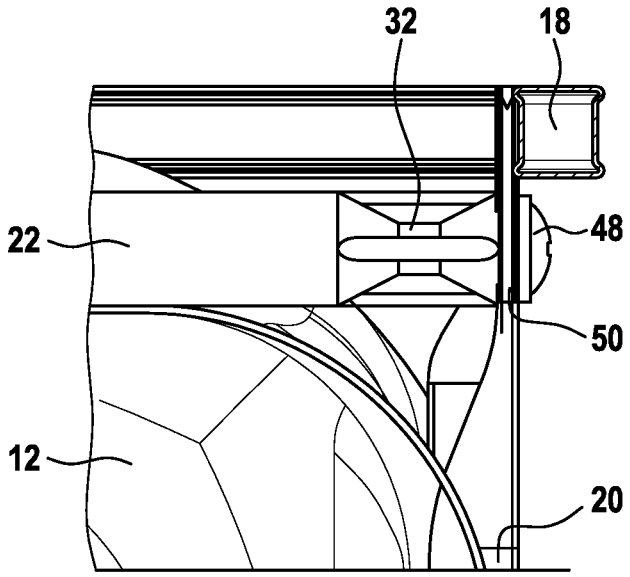
FIG. 9 is another enlarged partial side view of an end-side screw connection of a transverse cross-member.

FIG. 9 is a side view of the screw connection of a transverse cross-member 22 with a compressed portion 32 as an enlarged view. In this case, the transverse cross-member 22 is screwed close below the uppermost circumferential horizontal tubular rod 18 with its end face against a vertical tubular rod 20 of the tubular grid frame. The vertical tubular rod 20 is flattened in the region of the fastening point and has a through-hole for a screwed-in threaded screw 48 which is axially screwed into the compressed portion 32 which is provided with an internal thread. In order to ensure a good, comprehensive end-face contact of the transverse cross-members 22 with the corresponding vertical tubular rods 20, the flattened region is constructed in these vertical tubular rods 20 to be longer than in the adjacent vertical tubular rods (without transverse cross-members), wherein the free length of the completely flattened region 50 of the vertical tubular rods 20 is intended to be between 18 mm and 45 mm, preferably 32 mm, below the uppermost horizontally extending tubular rod 18. In a specific embodiment, the total length of the completely flattened region 50 is approximately 48 mm±2 mm, wherein the center of the through-hole for the threaded screw 48 is spaced apart from the upper edge of the flattened region 50 by approximately 38 mm±2 mm.

Figure 10:
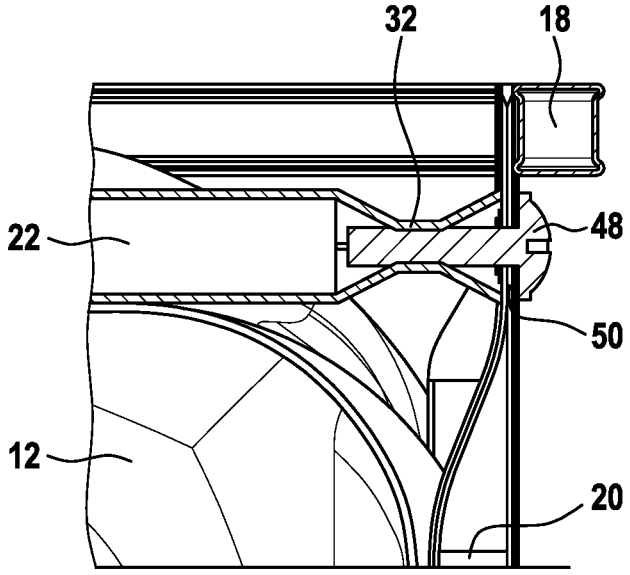
FIG. 10 is an enlarged partial cross-sectional view with an end-side screw connection of the transverse cross-member according to FIG. 9.

FIG. 10 again shows a cross section of the transverse cross-member screw connection from FIG. 9. In this case, the threaded screw 48 is provided with an integrated disk having an enlarged diameter for a greater contact surface with the flattened region 50 of the vertical tubular rod 20. Below the flattened region 50, a transition region follows which extends as far as the square base profile of the hollow tubular rod 20 (with a cross-sectional profile of 16×16 mm). By extending the flattened region 50 downward, the transition region is also displaced by a corresponding amount further downward in comparison with the adjacent vertical tubular rods.

Figure 11:
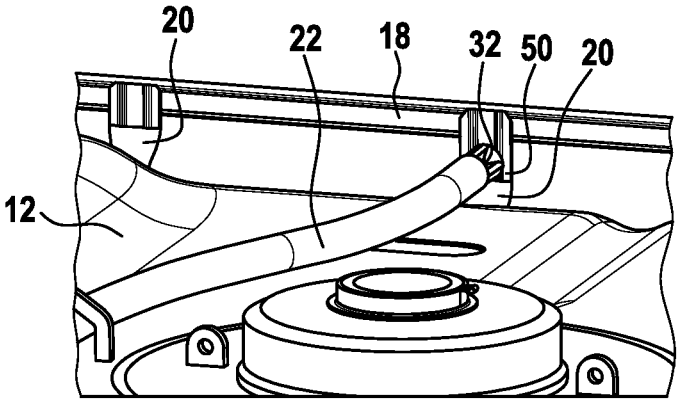
FIG. 11 is a partial perspective view of the end-side screw connection of the transverse cross-member according to FIG. 9.

Finally, FIG. 11 again shows a perspective partial view of the upper base of the plastics inner container 12 with a central screw cap. In this instance, the extended flattened region 50 of the vertical tubular rod 20 is again visible with the transverse cross-member 22 placed thereon. In this preferred embodiment, the transverse cross-members 22 (42) has a round or oval tubular profile with a diameter between 14 mm and 22 mm, preferably 16 mm, and a wall thickness between 0.7 mm and 1.2 mm, preferably 0.8 mm. With this type of screw connection, the threaded screws which are screwed axially into the transverse cross-members on the end face disappear completely in the hollow tubular profile of the transverse cross-members.

In all the disclosed variants, the two ends of the transverse cross-members 22, 42 are screwed with their end face to the uppermost horizontal tubular rod 18 or at four vertical tubular rods 20 of the tubular grid frame in a secure but releasable manner in order to exchange the plastics inner container 12.

The different curved versions of the transverse cross-members 22, 42 as a spring element allow a different design of the attachment with a horizontal or vertical screw connection of the two ends of the transverse cross-members 22, 42 to the upper tubular grid frame 14.

The described embodiments of the transverse cross-members and the fastening possibilities can readily be combined with each other and exchanged for each other in the context of the present invention.

CONCLUSION

As a result of the end-face screw connection of the transverse cross-members 22, 42 according to the invention with completely covered threaded screws—which virtually disappear in the ends of the transverse cross-members 22—in a pallet container 10, the upper region of the tubular grid frame 14 can be configured more safely in a comparatively simple manner with regard to any risk of injury and the operational safety during handling of filled pallet containers can be significantly increased.

LIST OF REFERENCE NUMERALS

10 Pallet container
12 Plastics inner container
14 Tubular grid frame
16 Base pallet
18 Horizontal tubular rods (14)
20 Vertical tubular rods (14)
22 Transverse cross-member
24 Spring element (22)
26 Fastening point (22)
28 Opposite fastening point (22)
30 Screw nut (22)
32 Compressed portion (22)
34 Large curve (22)
36 Small curve (22)
38 Upper base (12)
40 Retention lug (38)
42 Transverse cross-member with 2 curves
44 Internal thread (30)
46 Internal thread (32)
48 Threaded screw (30, 32)
50 Extended flattened region (20)

The invention claimed is:

1. A pallet container for storing and transporting fluid or flowable filling materials, the pallet container comprising:

a thin-walled, rigid plastics inner container made from thermoplastic plastics material;

a tubular grid frame which tightly surrounds the plastics inner container as a supporting covering and which comprises horizontal and vertical tubular rods which are welded to each other; and a base pallet on which the plastics inner container is positioned and to which the tubular grid frame is securely connected, wherein two rod-shaped transverse cross-members are provided above the plastics inner container and are fixed with two ends thereof via a screw connection by means of threaded screws to two mutually opposite side walls in an upper region of the tubular grid frame, wherein the transverse cross-members are screwed at their fastening points on an end face of their two ends against two mutually opposite tubular rods in the upper region of the tubular grid frame and the threaded screws axially lead into the ends of the transverse cross-members, wherein a screw nut with an internal thread is inserted in a non-releasably secure manner in both ends of the transverse cross-members having a hollow tubular profile and the transverse cross-members are releasably screwed an upper horizontal or vertical tubular rod of the tubular grid frame by the threaded screws which are screwed in on the end face.

2. A pallet container for storing and transporting fluid or flowable filling materials, the pallet container comprising:

a thin-walled, rigid plastics inner container made from thermoplastic plastics material;

a tubular grid frame which tightly surrounds the plastics inner container as a supporting covering and which comprises horizontal and vertical tubular rods which are welded to each other; and a base pallet on which the plastics inner container is positioned and to which the tubular grid frame is securely connected, wherein two rod-shaped transverse cross-members are provided above the plastics inner container and are fixed with two ends thereof via a screw connection by means of threaded screws to two mutually opposite side walls in an upper region of the tubular grid frame, wherein the transverse cross-members are screwed at their fastening points on an end face of their two ends against two mutually opposite tubular rods in the upper region of the tubular grid frame and the threaded screws axially lead into the ends of the transverse cross-members, wherein the two ends of the transverse cross-members are strongly compressed and an internal thread is directly formed in resulting compressed portions, wherein the transverse cross-members are releasably screwed to an upper horizontal or vertical tubular rod of the tubular grid frame by the threaded screws screwed in at the end face.

3. The pallet container as claimed in claim 1, wherein the two ends of the transverse cross-members are each screwed at two mutually opposite vertical tubular rods underneath the uppermost horizontally extending tubular rod.

4. The pallet container as claimed in claim 1, wherein the two ends of the transverse cross-members are screwed in a flattened region of the vertical tubular rods.

5. The pallet container as claimed in claim 1, wherein flattened regions of the vertical tubular rods attached to the transverse cross-members are flattened longer than flattened regions of the remaining vertical tubular rods.

6. The pallet container as claimed in claim 1, wherein a free length of a flattened region of the vertical tubular rods is between 18 mm and 45 mm below the uppermost horizontally extending tubular rod.

7. The pallet container as claimed in claim 1, wherein the two transverse cross-members each have one or more curved portions that are curved in a horizontal plane.

8. The pallet container as claimed in claim 1, wherein the two transverse cross-members each have a length between their corresponding two fastening points that is between 1% and 5% greater than a direct spacing between the corresponding two fastening points.

9. A pallet container for storing and transporting fluid or flowable filling materials, the pallet container comprising:

a thin-walled, rigid plastics inner container made from thermoplastic plastics material;

a tubular grid frame which tightly surrounds the plastics inner container as a supporting covering and which comprises horizontal and vertical tubular rods which are welded to each other; and a base pallet on which the plastics inner container is positioned and to which the tubular grid frame is securely connected, wherein two rod-shaped transverse cross-members are provided above the plastics inner container and are fixed with two ends thereof via a screw connection by means of threaded screws to two mutually opposite side walls in an upper region of the tubular grid frame, wherein the transverse cross-members are screwed at their fastening points on an end face of their two ends against two mutually opposite tubular rods in the upper region of the tubular grid frame and the threaded screws axially lead into the ends of the transverse cross-members, wherein the transverse cross-members which are screwed-in in a flattened region of the vertical tubular rods each have a curve bent in a horizontal plane, wherein the transverse cross-members are positioned flat on a top of the plastics inner container and the curves of the two transverse cross-members are orientated so as to be directed away from each other.

10. The pallet container as claimed in claim 1, wherein each of the transverse cross-members comprise a downwardly formed curve at each end and the downwardly formed curve of each end is screwed with their end faces from below against an uppermost circumferential horizontal tubular rod.

11. The pallet container as claimed in claim 1, wherein the transverse cross-members have a round or oval tubular profile with a diameter between 14 mm and 22 mm and a wall thickness between 0.7 mm and 1.2 mm.

12. The pallet container as claimed in claim 2, wherein the two transverse cross-members each have one or more curved portions that are curved in a horizontal plane.

13. The pallet container as claimed in claim 12, wherein the one or more curved portions of each transverse cross-member forms a resilient spring element.

14. The pallet container as claimed in claim 6, wherein the free length of the flattened region of the vertical tubular rods is 32 mm below the uppermost horizontally extending tubular rod.

15. The pallet container as claimed in claim 7, wherein the one or more curved portions of each transverse cross-member forms a resilient spring element.

16. The pallet container as claimed in claim 8, wherein the two transverse cross-members each have a length between their corresponding two fastening points that is 3% greater than the direct spacing between the corresponding two fastening points.

17. The pallet container as claimed in claim 9, wherein the curve of each transverse cross-member forms a resilient spring element.

18. The pallet container as claimed in claim 11, wherein the transverse cross-members have a diameter of 16 mm.

19. The pallet container as claimed in claim 11, wherein the transverse cross-members have a wall thickness of 0.8 mm.

* * * * *